United States Patent [19]

Bouchet

[11] Patent Number: 4,922,629

[45] Date of Patent: May 8, 1990

[54] ANTIWEAR AND NONSKID PROTECTIVE ELEMENT FOR A SHOE HEEL

[76] Inventor: Manoel Bouchet, Le Poil, 21200 Montagny-Les-Beaune, France

[21] Appl. No.: 355,807

[22] Filed: May 22, 1989

Related U.S. Application Data

[63] Continuation of Ser. No. 809,833, Dec. 9, 1985, abandoned.

[30] Foreign Application Priority Data

Dec. 10, 1984 [FR] France ..... 84 18805

[51] Int. Cl.[5] ..... A43B 21/36; A43B 21/39

[52] U.S. Cl. ..... 36/36 R; 36/36 C; 36/34 R

[58] Field of Search ..... 36/42, 36 R, 36 A, 36 C, 36/71.5, 34 R, 35 R, 35 A

[56] References Cited

U.S. PATENT DOCUMENTS

| | | | |
|---|---|---|---|
| 1,949,940 | 3/1934 | Monfils | 36/36 R |
| 2,852,864 | 9/1958 | Quirk | 36/36 R |
| 2,932,098 | 4/1960 | Lange | 36/34 R |
| 3,178,835 | 4/1965 | Burke et al. | 36/36 R |
| 4,403,426 | 9/1983 | Kaplan | 36/36 C |

FOREIGN PATENT DOCUMENTS

| | | | |
|---|---|---|---|
| 324845 | 5/1914 | Fed. Rep. of Germany | 36/36 R |
| 1408819 | 7/1965 | France | 36/34 R |
| 1260349 | 2/1968 | France | 36/42 |
| 50456 | 9/1966 | German Democratic Rep. | 36/42 |
| 605308 | 5/1960 | Italy | 36/34 R |
| 668034 | 9/1964 | Italy | 36/34 R |
| 915312 | 1/1963 | United Kingdom | 36/34 R |

*Primary Examiner*—Steven N. Meyers
*Attorney, Agent, or Firm*—Browdy and Neimark

[57] ABSTRACT

An antiwear and nonskid protective element for a shoe heel comprising (a) an outside first part having a through opening therein, the cross section surface of which increases from the surface contacting the heel to the free end surface; (b) an inside second part that can be fitted into the through opening; and (c) a connecting element for connection between the second part and the heel. The head of the connecting element is buried in the top of the inside part while the body is driven into the shoe heel.

10 Claims, 2 Drawing Sheets

ANTIWEAR AND NONSKID PROTECTIVE ELEMENT FOR A SHOE HEEL

This application is a continuation of application Ser. No. 809,833, filed Dec. 9, 1985 abandoned.

FIELD OF THE INVENTION

This invention relates to the field of shoemaking, and more particularly to a new antiwear and nonskid protective element fastened to the end of the heel of a shoe, particularly of a woman's shoe having a thin heel.

BACKGROUND OF THE INVENTION

Several types of protective elements, often designated by the term "Bonbout"(trademark), are already known in the field. These elements are commonly intended mainly to give the heel a nonskid feature, and to substitute direct wear of the heel, caused during walking, with wear of this element which can be easily replaced. The most known type consists of a simple piece of synthetic plastic resistant to wear and to suitable deformation, which is fastened to the end of the heel of a shoe with a simple shoemaker's nail which goes through it and which is driven into said end. To prevent the nail head from striking the ground when walking, it is known to provide in the piece a suitable reinforcement intended to receive said head, so that it cannot come in contact with the ground. However, as soon as a certain wear of the element occurs, it can be seen that the nail head becomes flush with its lower surface thus disadvantageously to damage the floor and/or cause excessive noise.

To reduce this drawback, it has been provided to bury the nail head inside the protective element. This solution, however, results in another disadvantage. Actually, because of the inherent flexibility of the material of the element, it is understood that fastening it to the end of the heel with a hammer does not result in the desired perfectly rigid assembly that is, and frequently this type of element has to be replaced long before its degree of wear makes it necessary, for example because of a premature separation of the assembly due to a misstep, an accidental impact, etc.

Finally, it is often found particularly with narrow heels (spike heels or others), that the protective element, after a certain time of use, can freely turn in relation to the heel, which is certainly disadvantageous both from the viewpoint of the stability of the shoe and the esthetic viewpoint. The solution to this problem consisting in fastening the element with a plurality of nails is not always possible, in particular because of the above-mentioned narrowness of the heel.

Moreover, a known drawback of all the known elements so far resides in the fact that their centering at the end of the heel is often delicate and imprecise.

SUMMARY OF THE INVENTION

This invention has as its object to reduce the drawbacks of the prior art and to propose a new element for wear and protection of a shoe heel whose fastening exhibits a good sturdiness during use, while being completely simple to achieve.

For this purpose, this invention proposes an antiwear and nonskid protection element for a shoe heel characterized in that it comprises; an outside first part in which a through opening is made whose cross section surface increases from a surface of contact with the heel to a free end surface; an inside second part that can fit into said opening; and a connecting element between said second part and the heel, whose head is buried in the top of the lower part while the body is driven into the shoe heel. The connecting element is in the form of a pin or nail having a pointed tip capable of penetrating the solid core of a shoe heel.

DESCRIPTION OF THE DRAWINGS

The invention will be better understood from reading the following detailed description of its preferred embodiments, given by way of example and made with reference to the accompanying drawings in which.

DESCRIPTION OF THE INVENTION

Figure 1:
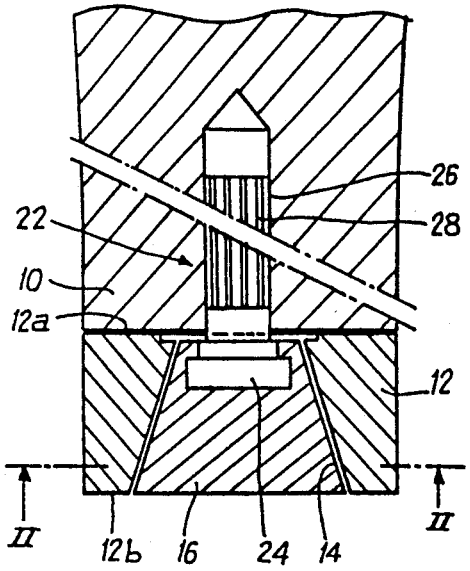
FIG. 1 is an elevation in section of a protective element for a heel according to the invention.
Figure 2:
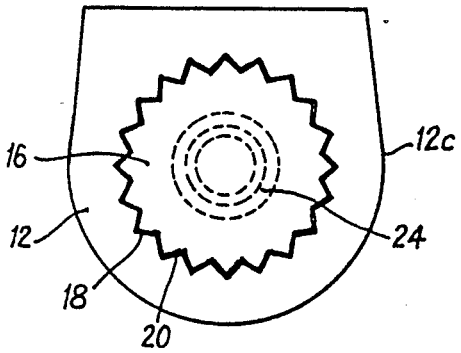
FIG. 2 is a view from below in section along line II—II of FIG. 1.

The lower end of a shoe heel 10 has been represented in FIG. 1. According to the invention, an antiwear and nonskid protective element for the lower end of this heel 10 comprises an outside first part 12, of a relatively strong material, such as metal or a plastic of suitable hardness, in the form of a piece exhibiting an upper face 12*a* and a lower face 12*b* that are parallel, and an outside profile 12*c* (FIG. 2) of a shape suited to the outside shape of heel 10. Between faces 12*a* and 12*b* of part 12 there extends an approximately tapered through opening 14 whose cross section narrows toward upper face 12*a*. The protective element further comprises a second tapered inside part 16 whose shape and dimensions correspond approximately to those of opening 14 and which is received inside said opening 14. Preferably, parts 12 and 16 are made of the same plastic, so that the wear of the surface of the element in contact with the ground is uniform. As FIG. 2 shows, parts 12 and 16 are made solid in rotation, when they are assembled, by a plurality of complementary triangular ribs or scores 18, 20 provided respectively on the faces of parts 12 and 16 in mutual contact.

According to a first embodiment, illustrated in FIG. 1, the element for connecting to heel 10 consists of a nail or fastening pin 22 solid with inside part 16. In this respect, nail 22 has a head 24 which is buried in the upper (narrowest) region of part 16. Shank 26 of the nail comes out vertically above said part 16, and exhibits on its surface a plurality of longitudinal grooves 28, for purposes explained below.

In a suitable manner, the solid unit consisting of part 16 and nail 22 will be made by duplicate-molding said part 16 on head 24 of the nail.

The mounting of the antiwear and nonskid protective element as described above can be done by first placing outside part 12 at the end of heel 10 so that it extends in the extension of said end, then by nailing inside part 16 by inserting it into opening 14, shank 26 of nail 22 being simultaneously driven into heel 10, until the lower faces of parts 12, 16 extend approximately in the same plane.

It is understood that outside part 12 is thus firmly immobilized, thanks both to the tapered shape of the cooperating surfaces of parts 12, 16 and to additional scores 18, 20 which these surfaces carry. Grooves 28 of nail 22 prevent any undesirable rotation of parts 12, 16 that are made solid.

Figure 3:
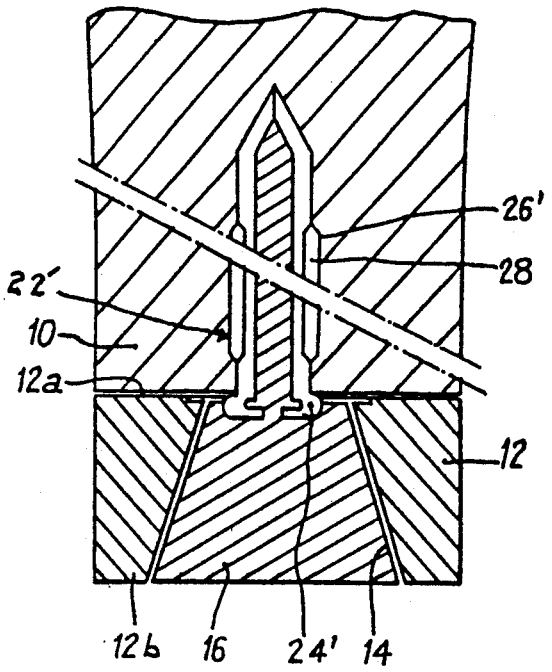
FIG. 3 represents a variant embodiment of the connecting element.

According to the advantageous variant illustrated in FIG. 3, the connecting element here is by a kind of tubular pin 22' whose head 24' has a hook shape whose lips are bent back toward the inside and which thus leaves a hollow space free inside body 26' of this pin. By using an injected plastic to make part 16, this part can then be duplicate-molded with head 24' of the pin and the plastic allowed to go into the hollow space. As in said case of the nail, body 26' of the pin advantageously exhibits a plurality of longitudinal grooves 28 which make it possible to prevent any rotation of the pin when it is force-fitted inside shoe heel 10.

It will be noted that the design of the element of the invention makes possible a completely easy and precise centering of the element at the end of the heel thanks to the presence of outside part 12 which serves as a guide during the fastening.

The advantages brought by nail 22 of FIG. 1 are further enhanced when this latter is replaced with pin 22' according to the variant of FIG. 3. In particular, the pin and duplicate-molded part 16 can be connected more homogeneously, which makes it possible to increase the resistance to tearing off of the protective element in relation to the heel of the shoe. Moreover, thanks to the lips bent back toward the inside of head 24' of the pin, the resistance to pivoting of this latter is increased in part 16. Finally, because of these improvements brought by the pin, it is possible to reduce the dimensions of opening 14 and of the associated inside part 16, which offers an advantage for women's shoe heels having a very small surface resting on the ground.

Of course, this invention is in no way limited to the embodiments described above, but it includes any variant or modification that one skilled in the art could bring to it. In particular, the tapered cooperating surfaces of parts 12, 16 could be replaced with stepped surfaces that widen out toward the the free end of the element. Further, scores 18, 20 could be replaced by any other form of cooperation with grooves and ribs, keys, etc. Finally, the materials chosen for parts 12 and 16 will be selected so as to be suited to the desired function.

I claim:

1. An anti-wear and non-skid protective element for the lower end of a solid-core shoe heel comprising:

an outside first part formed of hard plastic having an upper face and a lower face, said faces being parallel to each other, and a through opening extending between said faces;

a tapered inside second part formed of hard plastic and having a height approximately the same as that of said outside first part and an upper face having a first area and a lower face having a second area which is greater than said first area, said tapered inside second part having a shape and dimension such that it can be forced within said through opening so as to be tightly retained therein in such a way as to prevent rotation between said outside first part and said inside second part; and connecting means for connecting the outside first part and the inside second part to the lower end of the shoe heel, said connecting means consisting of a single pin having a shank formed at least partly of metal and axially positioned relative to said tapered inside second part, said pin comprising a shell and a plastic core and having a head which is integral with and mechanically anchored within said inside second part and serving as a support for said inside second part, the shank of said pin having on its surface a plurality of longitudinal grooves, said pin further having a pointed tip capable of penetrating the solid core of the shoe heel, and said plastic core and said tapered inside second part being unitary.

2. A protective element according to claim 1, wherein said tapered inside second part is injection molded about the head of said pin.

3. A protective element according to claim 1, wherein the head of said pin has an open hook-shaped configuration.

4. A protective element according to claim 3, wherein said core and said inside second part being injection molded about the head of said pin and therewithin.

5. A protective element according to claim 1, wherein said tapered inside second part is of generally frustoconical configuration having a ribbed exterior.

6. The combination of a shoe and an anti-wear and non-skid protective element for the lower end of a heel of said shoe, comprising:

a shoe having a spike heel of relatively small cross-section, said heel having a solid core and a lower end; and an anti-wear and non-skid protective element mechanically fixed to the lower end of said spike heel having a solid core, said anti-wear and non-skid protective element comprising:

(i) an outside first part formed of hard plastic having an upper face and lower face, said faces being parallel to each other with said upper face being adjacent the lower end of said spike heel, and a tapered through opening extending between said faces, said tapered through opening having an axial cross-section which narrows toward the upper face of said outside first part;

(ii) a tapered inside second part formed of hard plastic having a shape and dimensions complementary to those of the through opening and which is received in said through opening; and (iii) a single connecting element mechanically fixing said anti-wear and non-skid protective element to the lower end of said shoe heel, said connecting element consisting of a nail axially positioned relative to said tapered inside second part and formed at least partly of metal and having a shell and a plastic core, said nail having a head integral with and mechanically anchored within said tapered inside second part, said nail further comprising a shank and a pointed tip buried within the solid core of said spike heel, said nail shank having on its surface a plurality of longitudinal grooves, said plastic core and said tapered inside second part being unitary.

7. A combination according to claim 6, wherein said tapered inside second part is injection molded about the head of said nail.

8. A combination according to claim 6, wherein the head of said nail has an open hook-shape configuration.

9. A combination according to claim 8, wherein said plastic core and said inside second part are injection molded in one piece.

10. A combination according to claim 6, wherein said tapered inside second part is of generally frustoconical configuration having a ribbed exterior.

* * * * *